United States Patent [19]

Shell

[11] 4,443,186

[45] Apr. 17, 1984

[54] SOLAR HEATED ROTARY KILN

[75] Inventor: Pamela K. Shell, Tracy, Calif.

[73] Assignee: The United States of America as represented by the United States Department of Energy, Washington, D.C.

[21] Appl. No.: 368,198

[22] Filed: Apr. 14, 1982

[51] Int. Cl.[3] ..... F27B 7/00; F27B 6/08; F26B 19/00

[52] U.S. Cl. ..... 432/103; 34/93; 126/417; 373/20; 432/112

[58] Field of Search ..... 432/103, 112; 34/93; 373/10, 11, 20, 22; 126/417, 439

[56] References Cited

U.S. PATENT DOCUMENTS

| | | | |
|---|---|---|---|
| 549,765 | 11/1895 | Calver | 126/45 |
| 1,378,710 | 5/1921 | Meyerhofer | 432/103 |
| 1,442,696 | 1/1923 | Nutt | 126/417 |
| 2,158,689 | 5/1939 | Buchanan | 432/112 |
| 2,793,018 | 5/1957 | Trombe | 432/3 |
| 2,963,530 | 12/1960 | Hanks et al. | 373/10 |
| 3,829,283 | 8/1974 | Wulf | 432/103 |
| 3,830,950 | 8/1974 | Schoumaker et al. | 373/20 |
| 4,000,733 | 1/1977 | Pauly | 126/451 |
| 4,029,572 | 6/1977 | Theodore et al. | 432/112 |
| 4,117,882 | 10/1978 | Shurcliff | 126/417 |
| 4,229,184 | 10/1980 | Gregg | 126/438 |

FOREIGN PATENT DOCUMENTS

| | | | |
|---|---|---|---|
| 240981 | 1/1911 | Fed. Rep. of Germany | 432/112 |
| 1042805 | 11/1953 | France | 432/103 |

OTHER PUBLICATIONS

UCRL-85743, "A Proposed Solar Furnace Study of Zinc Sulfate Decomposition", O. H. Krikorianand P. K. Shell, 4-16-81.

UCID-19242, "A Rotary Kiln for the Solar Decomposition of Zinc Sulfate", Pamela K. Shell et al., 11-11-81.

*Primary Examiner*—John J. Camby

*Attorney, Agent, or Firm*—L. E. Carnahan; Roger S. Gaither; Michael F. Esposito

[57] ABSTRACT

A solar heated rotary kiln utilized for decomposition of materials, such as zinc sulfate. The rotary kiln has an open end and is enclosed in a sealed container having a window positioned for directing solar energy into the open end of the kiln. The material to be decomposed is directed through the container into the kiln by a feed tube. The container is also provided with an outlet for exhaust gases and an outlet for spent solids, and rests on a tiltable base. The window may be cooled and kept clear of debris by coolant gases.

19 Claims, 6 Drawing Figures

SOLAR HEATED ROTARY KILN

BACKGROUND OF THE INVENTION

The invention described herein arose at the Lawrence Livermore National Laboratory in the course of, or under, Contract No. W-7405-ENG-48 between the United States Department of Energy and the University of California.

The invention relates to rotary kilns, particularly to solar heated rotary kilns, and more particularly to such rotary kilns for the decomposition of materials such as zinc sulfate.

Various types of solar kilns are known in the art as exemplified by U.S. Pat. Nos. 2,793,018 issued May 21, 1957 to F. Trombe, and 3,829,283 issued Aug. 13, 1974 to K. A. Wulf. In addition, the use of solar or radiant energy for heating furnaces or kilns is known, as exemplified by above-referenced U.S. Pat. No. 3,829,283 and U.S. Pat. Nos. 549,765 issued Nov. 12, 1895 to W. Calver, and 4,000,733 issued Jan. 4, 1977 to L. A. Pauly.

Today there is a great interest in the development of thermochemical cycles for hydrogen production. A most difficult step in these processes is the high temperature thermal decomposition of sulfuric acid or solid sulfates.

With the recent energy conservation efforts and with the development of solar energy systems, efforts have been direct to utilizing this energy source in the thermochemical production of hydrogen from water. Solar furnaces, such as the 30 kW White Sands Solar Facility in operation at White Sands, New Mexico, produce high grade heat which potentially can drive the endothermic reactions involved in the thermochemical production of hydrogen from water. Thus, efforts have been directed to utilizing this high grade heat source in a zinc sulfate subcycle for producing hydrogen. In view of these efforts a need exists for an effective way of decomposing substances with poor absorptivities, such as zinc sulfate, utilizing solar energy. It has been found that materials, such as zinc sulfate, decompose most effectively utilizing direct radiant heating in addition to conductive/convective heating.

Therefore, an object of this invention is to provide an apparatus utilizing solar energy for decomposing materials, such as zinc sulfate, having poor absorptivities.

A further object of the invention is to provide an apparatus for decomposing materials having poor absorptivities while utilizing radiant heating in addition to conductive/convective heating.

Another object of the invention is to provide a rotary kiln for the solar decomposition of materials, such as zinc sulfate, having poor absorptivities.

Another object of the invention is to provide a solar heated rotary kiln which provides direct radiant heating in addition to conductive/convective heating.

Still another object of the invention is to provide a solar heated rotary kiln for decomposition of zinc sulfate.

Other objects of the invention will become apparent from the following description and accompanying drawings.

SUMMARY OF THE INVENTION

The above objects of the present invention are carried out by a solar heated rotary kiln having an open end and enclosed in a sealed container having a window positioned for directing solar energy into the open end of the kiln. The rotary kiln is heated to a temperature in the range about 1200°-1500° K. and is constructed such that material passing through the kiln is decomposed by direct radiant heating in addition to conductive/convective heating. The rotary solar heated kiln is particularly applicable for the decomposition of zinc sulfate or other materials having poor absorptivities.

More specifically, the solar heated rotary kiln includes three critical parts; namely a feed mechanism, a kiln and a sealed container having a window. The kiln consists of three main components: an inner liner, thermal insulation, and an outer wall. The kiln is sealed within the container and the window is located such that solar energy is directed into an open end of the kiln. The container is mounted on a tilt mechanism and provided with means for collecting gases produced by the decomposition and means for collecting any remaining solids.

DETAILED DESCRIPTION OF THE INVENTION

The present invention is directed to a solar heated rotary kiln which is particularly adapted for use in the decomposition of materials having poor absorptivities, such as zinc sulfate.

While the following description of the invention will be directed to its application for the decomposition of zinc sulfate, it is not intended to limit the invention to any specific use. However, for additional details relative to the invention's utilization for decomposing zinc sulfate, attention is directed to UCRL-85743 entitled "A Proposed Solar Furnace Study of Zinc Sulfate Decomposition" by O. H. Krikorian et al, bearing the date of Apr. 16, 1981, published by the Lawrence Livermore Laboratory, University of California; and UCID-19242 entitled "A Rotary Kiln for the Solar Decomposition of Zinc Sulfate" by Pamela K. Shell et al, bearing the date of Nov. 11, 1981, published by the Lawrence Livermore Laboratory, University of Calif.

Figure 1:
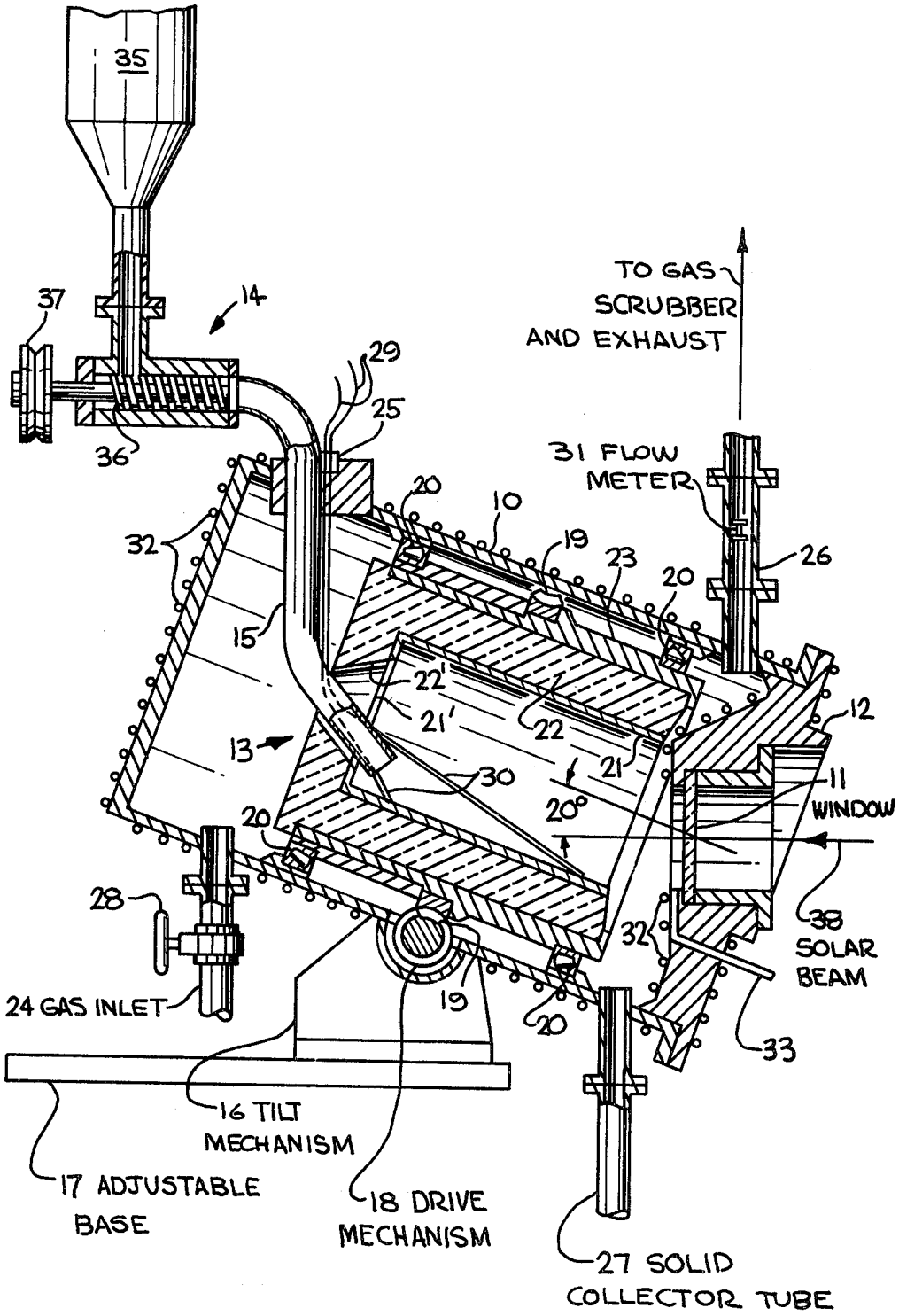
FIG. 1 is a view, partially in cross section, of an embodiment of a solar heated rotary kiln in accordance with the invention.
Figure 2:
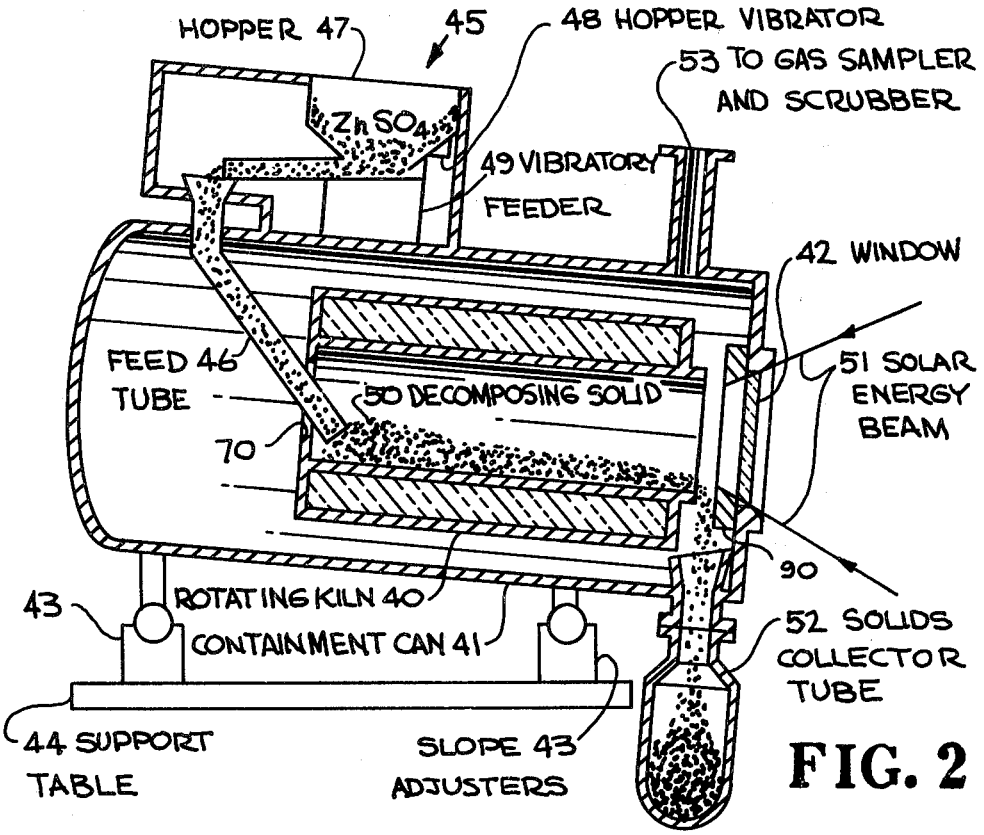
FIG. 2 is a schematic view of another embodiment of a solar heated rotary kiln of the invention.

The invention, as illustrated in the embodiments of FIGS. 1 and 2 basically consists of three critical parts: a feed mechanism, a rotary kiln, and a sealed container or can about the kiln which is provided with a window for admitting solar energy into the kiln.

Figure 3:
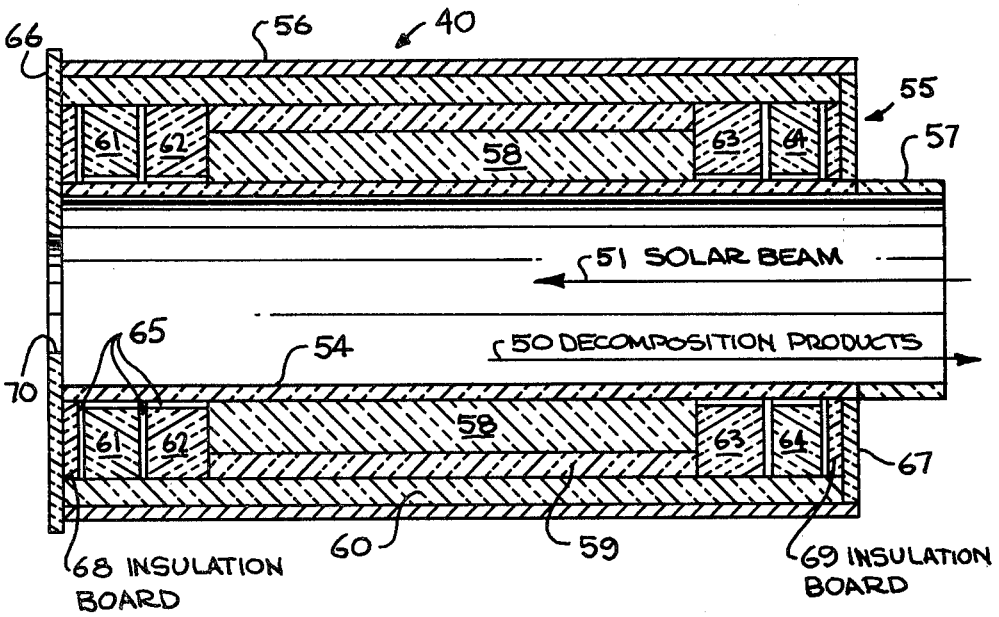
FIG. 3 is a cross-sectional view of the kiln of the FIG. 2 embodiment.

The kiln, as seen in FIGS. 1 and 3, consists of three main components: an inner liner, thermal insulation, and an outer wall. The liner is designed to be the primary surface exposed to the solar energy beam. The insulation is used to retain energy in the kiln in the form of heat. The outer wall serves two purposes, i.e., to hold the kiln together and to receive the rotary motion from the drive train illustrated in FIGS. 1, 4 and 5.

Figure 6:
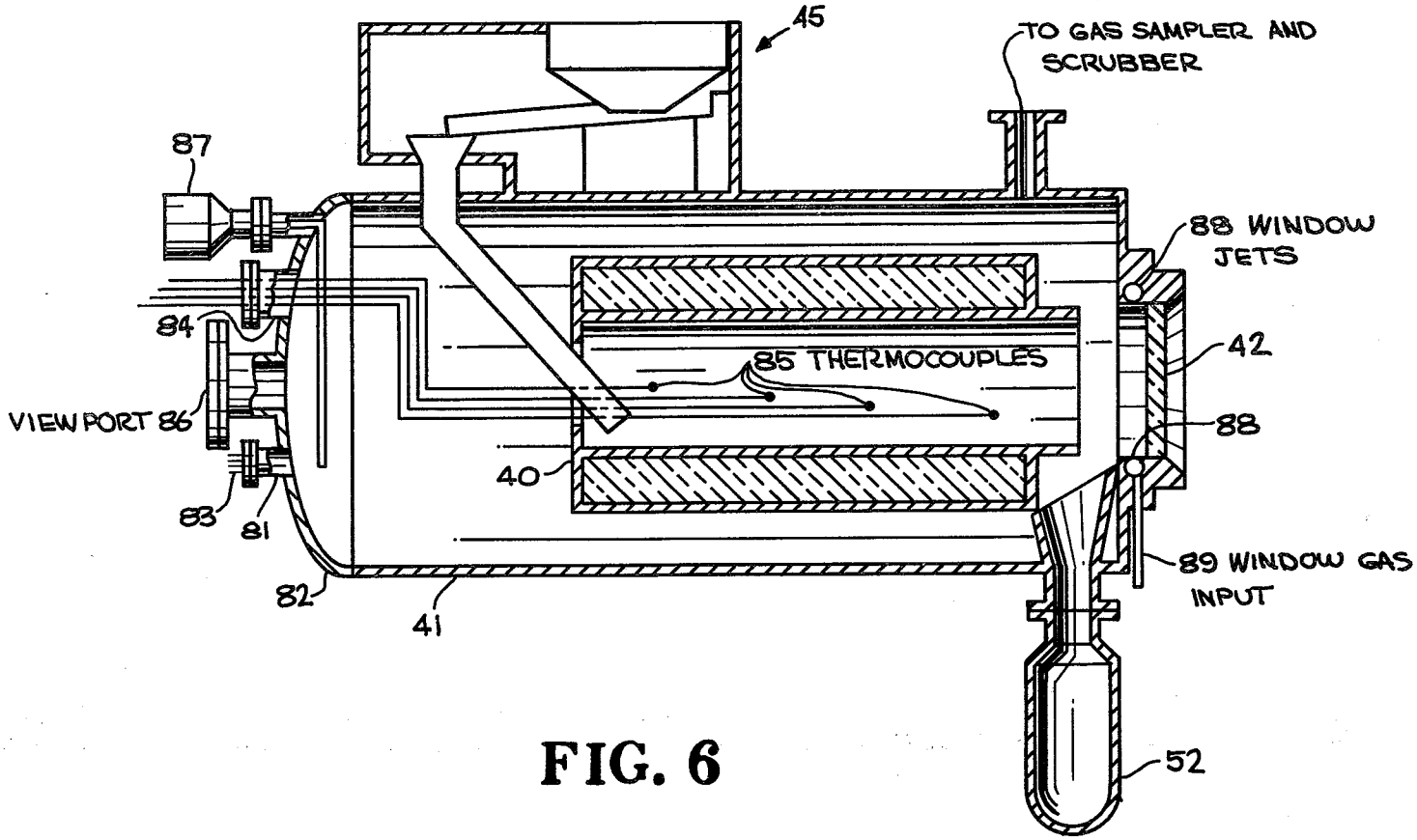
FIG. 6 is a schematic view of the FIG. 2 embodiment illustrating the auxiliary systems of the rotary kiln.

To enable visual and temperature monitoring of the rotary kiln, it is provided with viewport and thermocouple mechanisms, as shown in FIG. 6. Also, as shown in FIGS. 1 and/or 6, the embodiments of the invention are provided with cooling means and means for cleaning and cooling the window of the sealed container.

Referring now to the FIG. 1 embodiment, the solar heated rotary kiln basically consists of an outer containment can or housing 10 having a window 11 mounted in one end section 12, a rotary kiln generally indicated at 13 is rotatably mounted within containment can 10, and a feed mechanism generally indicated at 14 which includes a feed tube 15 extending through can 10 into rotary kiln 13. By way of example, containment can 10 may be constructed of stainless steel with window 11 to be constructed of quartz.

The outer sealed containment can 10 is mounted on a tilt mechanism 16 which in turn is mounted on an adjustable base 17. A drive mechanism generally indicated at 18 for rotary kiln 13 is mounted in tilt mechanism 16 and may, for example, consist of a variable speed motor or gearing arrangement and a worm gear, the worm gear being meshed with a drive gear 19 which extends around kiln 13.

Kiln 13 is rotatably supported in can 10 by a plurality of bearing assemblies 20 (four shown). The rotary kiln is composed of three components: an inner liner 21 of cylindrical configuration having an outer open end and an opening 21' in the inner closed end, and insulation layer 22 having a tapered opening 22', and an outer wall or casing 23 to which is secured the drive gear 19 and the bearing assemblies 20. For example, the inner liner 21 may be constructed of $Al_2O_3$, the insulation layer 22 may be of castable $Al_2O_3$, and outer wall 23 may be constructed of high Ni/Cr stainless steel. While not shown, the outer or open end of inner liner 21 may extend outwardly past the surface of the insulation layer 22 to prevent the material passing therethrough from coming in direct contact with the insulation layer. The opening 21' in inner liner 21 and tapering opening 22' in insulation layer 22 allow for the rotation of kiln 13 about feed tube 15 which extends into liner 21 at an angle with respect to a longitudinal axis of the rotary kiln 13.

Outer containment can 10 is provided with four openings in which are mounted a gas inlet assembly 24, a feedthrough assembly 25, a gas outlet assembly 26, and a solids collector tube assembly 27. Gas inlet assembly 24 is provided with a control valve 28. Feedthrough assembly 25 provides for sealed passage of feed tube 15 and leads 29 for a pair of thermocouples 30 positioned in spaced relation along inner liner 21. Gas outlet assembly 26 is provided with a flow meter 31 and is connected to a gas scrubber and exhaust as indicated by legend. The solids collector tube assembly 27 is constructed to collect the solid decomposition products after the material passes through rotary kiln 13.

Outer containment can 10 is also provided around the periphery with cooling coils 32 which are connected to a coolant supply, not shown. Note that end section 12 of can 10 is also provided with cooling coils 32 on the inner surface so as to cool the window 11. In addition, end section 12 is provided with at least one gas inlet passage 33, connected to a cooling gas supply, not shown (such as argon or nitrogen under pressure) which is utilized to direct a jet of gas across the window 11 to purge the window of any debris or contamination as well as to provide cooling for the window.

Feeder mechanism 14 includes a hopper 35 into which material, such as zinc sulfate ($ZnSO_4$), is directed into a screw feed mechanism 36, the output of which is directed into feed tube 15. Screw feed mechanism 36 is driven via a pulley 37, for example, operatively connected to a drive mechanism, not shown.

Window 11 is positioned in end section 12 of containment can 10 and can 10 is tilted by mechanism 16 such that a beam of solar energy 38 is directed through window 11 onto the surface of inner liner 21 of rotating kiln 13. As shown in FIG. 1 the containment can 10 is tilted such that the longitudinal axis forms a 20° angle, with respect to the solar beam 38. The angle can be readily changed by tilt mechanism 16 and is determined by the type of materials to be decomposed, the temperatures involved and the energy of the solar beam.

In operation, with the apparatus tilted as shown in FIG. 1, the zinc sulfate is input into the kiln 13 through feed tube 15. The rate at which zinc sulfate moves through the kiln is controlled by the rate of input, the speed of rotation of the kiln, and the tilt angle of the kiln. The solid decomposition products falls out of the open end of the kiln and are collected in tube assembly 27 located at the bottom of can 10. Decomposition product gases are collected through gas outlet assembly 26, by gas being directed into can 10 via gas inlet assembly 24, and passed to a gas scrubber for separation from the gas passed through the can. The solar heated kiln operates at a temperature of about 1200°–1500° K. It is desirable to have a large surface area and volume in the kiln compared to the window diameter so that most of the solar energy is captured inside the kiln and little is reradiated out.

A restrictor 90 (see FIG. 2) can be placed near the open end of the kiln 40 adjacent window 42 to provide a variable opening for the focused solar beam to enter but allow for little loss of scattered or reradiated solar energy. Note that solar beam 51 starts to diverge at the tip of the restrictor 90. While not shown, positioning of the resistor 90 can be adjusted by moving same toward or away from the kiln 40, thereby changing the point that the beam strikes the material 50. Restrictor adjustment may be accomplished by conventional apparatus supported by the can 41. The insulation layer 22 around the liner 21 also prevents loss of energy while also helping to keep the bearings cool.

The window, located in the containment can, not in the kiln, is water cooled and gas cooled. The window cooling gas also serves to keep particles from collecting on the window. This cooling and purging maintains the full efficiency of the solar energy beam passing through the window.

For further details of the application of the FIG. 1 embodiment for the use in zinc sulfate decomposition, attention is directed to above-referenced document UCRL-85743.

The embodiment illustrated in FIGS. 2–6 differs from the FIG. 1 embodiment primarily in the construction of the feeding mechanism, the rotary kiln, and the rotating mechanism for the kiln.

The rotary kiln is contained in the outer can so as to overcome the usual problem of moving seals which would be required for the drive system entrance, the zinc sulfate entrance and exit points for the solid and gaseous products. The only seals in the apparatus of the invention are confined to the relatively cool containment can which greatly simplifies the problem of working with sealed hot systems.

Referring now to the embodiment of FIGS. 2–6, a rotating kiln 40 is mounted within a sealed containment can 41 having a window 42 (fused-quartz, for example) in one end, can 41 being mounted on slope adjusters 43 which in turn are mounted on a support table or platform 44. Located at the top of containment can 41 is a feed mechanism generally indicated at 45 for feeding material such as $ZnSO_4$, through a feed tube 46 into kiln 40. Feed mechanism 45 consists of a hopper 47, a hopper vibrator 48, and a vibratory feeder 49 which is positioned to supply material into feed tube 46. As shown in FIG. 2, decomposing solid material 50, supplied from hopper 47 through feed tube 46, is processed within rotating kiln 40. Kiln 40 is heated by a solar energy beam 51 which passes through window 42 into an open end of the kiln.

The material 50 ($ZnSO_4$, exemplified here) tumbles down through the rotary kiln 40, absorbing energy through both conductive/convective heating and direct radiant heating, and decomposes to form zinc oxide, sulfur dioxide, oxygen, and sulfur trioxide. The retention time of material 50 within kiln 40 is easily controlled by varying the rotation rate and/or the angle of tilt of the kiln.

As the material is processed, the remaining solid products drop from kiln 40 into a solids collector tube 52, while gases producted by the reaction or processing of the material 50 is drawn off via an outlet or exhaust 53 which is connected to a gas sampler and scrubber, as indicated by legend in FIG. 2. While not shown, containment can 41 may be provided with a gas inlet as in the FIG. 1 embodiment, through which dry gases such as argon, nitrogen or air are injected.

The rotary kiln 40 in this embodiment, as illustrated in FIG. 3, consists of three main components: an inner liner 54, thermal insulation generally indicated at 55, and an outer wall or casing 56.

The inner liner 54 is designed to be the primary surface exposed to solar energy beam 51. The liner material must have both high thermal stress resistance and good thermal insulating properties. In addition, liner 54 must be resistant to corrosive gases generated and compatible with the solids involved. On the basis of three criteria, the liner, for example, may be constructed of alumina, mullite, or Inconel-600. The inner liner 54, as shown in FIGS. 2 and 3, includes a protruding or lip portion 57 which extends beyond the thermal insulation. This lip 57 prevents the decomposing solids from getting into the rotary kiln drive mechanism illustrated in FIG. 4, and protects the outer kiln wall from seeing the solar energy beam 51. While not shown, to prevent the lip 57 from serving as a radiating source of energy, it is surrounded on the outside with insulation, such as approximately one inch (2–3 cm) of Zircar sheet insulation held loosely in place with a stainless steel collar.

The thermal insulation 55 surrounding liner 54 basically consists of two forms of insulation: cast and fibrous. As shown in FIG. 3, insulation 55 consists of an inner layer 58, such as Kast-O-lite 30 castable insulation, an intermediate layer 59, such as Zircar insulation, an outer layer 60, such as Fiberfax insulation, and two sets of cast alumina rings 61–62 and 63–64, such as castable $Al_2O_3$. While the insulation 55, as illustrated, is only three inches thick it is equivalent to about nine inches of firebrick. The sets of rings are positioned at opposite ends of layers 58 and 59, with outer layer 60 extending around the ring sets. Each of the rings of ring sets 61–62 and 63–64 is cast in two to four sectioned parts. When these parts are clamped into a ring around inner liner 54 there is sufficient room between the individual parts to allow for thermal expansion due to expansion joints indicated at 65.

Outer wall 56, constructed of stainless steel for example, is closed at both ends by end plates 66 and 67 of stainless steel, while insulation boards 68 and 69 are located intermediate the ring sets and the end plates 66 and 67. End plate 66 is provided with an opening 70 through which feed tube 46, carrying material (such as $ZnSO_4$) to be decomposed, extends. Opening 70 is constructed so as to allow for rotation of kiln 40 about feed tube 46.

Figure 4:
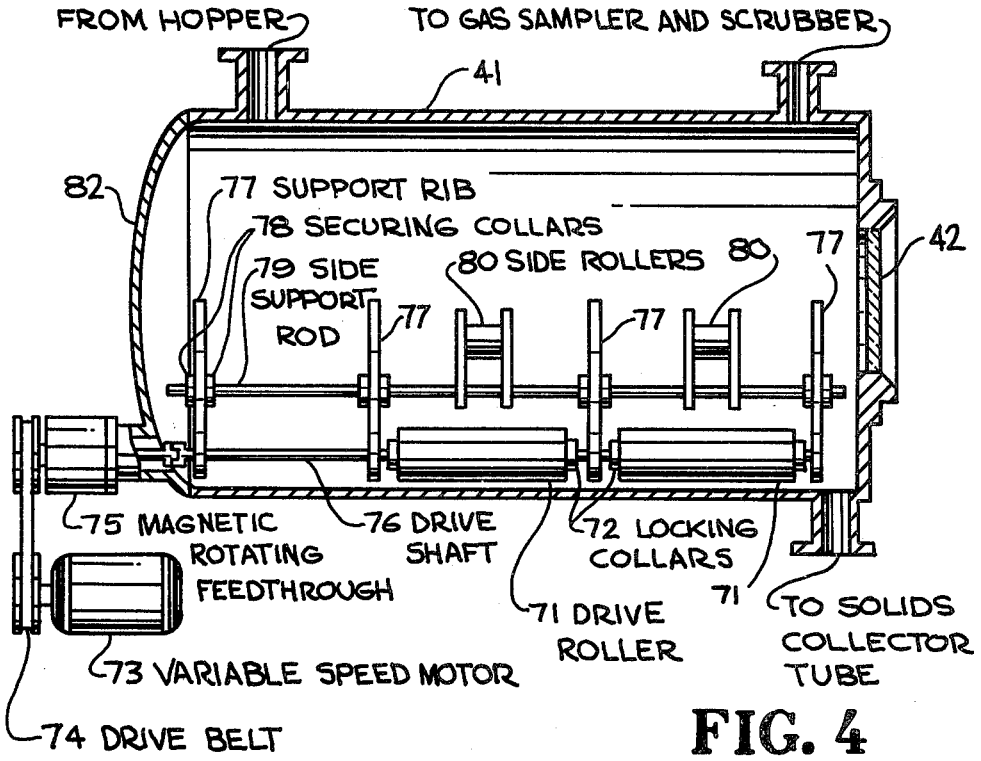
FIG. 4 illustrates the drive mechanism of the FIG. 2 embodiment.
Figure 5:
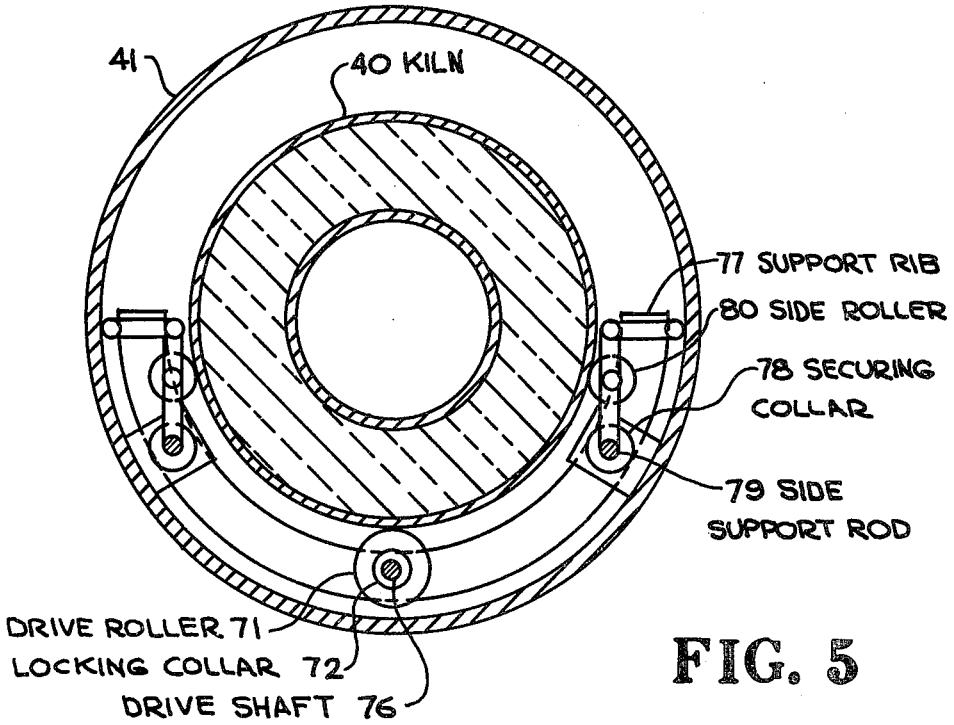
FIG. 5 is a schematic of an end on view of the FIG. 2 embodiment showing the kiln support and turning mechanism within the outer containment can.

The drive train or mechanism for rotating kiln 40 is shown in FIGS. 4 and 5. The drive train utilizes a drive roller arrangement instead of gears which eliminates gear problems due to the high temperatures of operation, as well as the corrosiveness of the product gases and the presence of gas-borne particulate matter. The kiln 40 is turned or rotated by frictional contact with the drive rollers. The kiln 40 rests on a pair of drive rollers 71 which are placed end-to-end and interconnected by locking collars 72. Drive rollers 71 are driven by a variable speed motor 73 through a drive belt 74, magnetic rotating feedthrough 75 and drive shaft 76. A plurality (four in this embodiment) of support ribs or plates 77 are located in spaced relation along the length of drive rollers 71 and drive shaft 76 and are secured to containment can 41 via securing collars 78 and interconnected by side suppport rods 79. The drive shaft 76 is held in position by passing through an opening in the bottom center of the support ribs 77. A plurality of side idling roller assemblies 80 are mounted on each side of kiln 40 between the support ribs 77, and are secured to side support rods 79. The side roller assemblies 80 hold the kiln 40 in place by wedging against the kiln and the containment can 41 and keep the kiln from rolling off the drive rollers 71.

The drive rollers 71 are grooved to increase the friction with the kiln 40. Due to the external location of the drive train components 73 & 74, only the drive shaft 76 extends into feedthrough 75 mounted on a removable back flange or end section 82 of containment can 41. The remote location of the feedthrough 75 relative to the solar beam helps assure a low operating temperature for the feedthrough.

The advantage of the drive train arrangement illustrated in FIGS. 4 and 5 is its adjustability. By altering the position of the support ribs 77, the location of the drive rollers 71 (and the kiln 40) can be shifted within the containment can either towards or away from the window 42. This also alters the location of the kiln with respect to the focal plane of the solar beam 51. In addition, this arrangement allows rapid and easy access to any part of the kiln which may need servicing or replacement.

As shown in FIG. 6, the removable back flange or end section 82 of containment can 41 may support several auxiliary systems. A thermocouple feedthrough 81 is secured to end section 82 and through which extend a plurality of leads 83 connected to auxillary thermocouples (not shown) located in the can 41. A feedthrough 84 may be provided for leads from thermocouples 85 located along the length of kiln 40 to monitor the temperature at various points along the kiln. A view port 86 is mounted in end section 82 and positioned in axial alignment with kiln 40. A viewport shutter mechanism 87 is mounted on end section 82. The mechanism 87 serves to completely block the beam from view through viewport 86 unless opened for viewing the kiln. The viewport 86 may include a fused quartz viewport shielded with welder's glass.

Also as shown in FIG. 6, a plurality of window jets 88 are connected to gas inputs 89 for directing cooling and/or cleaning gas, from a source not shown, over the interior surface of window 42.

The slope adjusters 43 (see FIG. 2) establish the angle of tilt of the kiln 40, which for example may be 5°. Adjusters 43 also provide for adjustment of the actual height of the kiln, so that it can be fine-tuned into the solar beam 51.

For further details relative to the embodiment of the invention illustrated in FIGS. 2–6, reference should be made to above-cited document UCID-19242.

It has thus been shown that the present invention provides a solar heated rotary kiln for decomposing materials having poor absorptivities, such as zinc sulfate. The decomposition is carried out in a solar heated kiln utilizing direct radiant heating in addition to conductive/convective heating.

While particular embodiments of the invention have been illustrated and described, modifications will become apparent to those skilled in the art and it is intended to cover in the appended claims all such modifications as come within the scope of the invention.

I claim:

1. A solar heated rotary kiln for decomposing material comprising:

a sealed container having a window therein for admitting solar energy therethrough, a kiln rotatably mounted entirely within said sealed container, said kiln being of a substantially cylindrical configuration and having one end fully open and aligned with said window such that solar energy passing through said window is directed only into said fully open one end of said kiln, said kiln including an inner layer, a layer of insulation, and an outer wall, means for directing material to be decomposed into said kiln through a partially closed end thereof located opposite said open end, means for rotating said kiln, means for exhausting gas from said sealed container, and means located adjacent said fully open end of said kiln for collecting solids passing through said kiln.

2. The solar heated rotary kiln of claim 1, additionally including mechanism for tilting said sealed container.

3. The solar heated rotary kiln of claim 2, wherein said tilting mechanism also includes means for raising and lowering said sealed container.

4. The solar heated rotary kiln of claim 1, additionally including means for directing a flow of gaseous material across said window.

5. The solar heated rotary kiln of claim 2, wherein said window is constructed of quartz.

6. The solar heated rotary kiln of claim 1, additionally including a plurality of bearing assemblies positioned between said kiln and said sealed container.

7. The solar heated rotary kiln of claim 1, wherein said means for rotating said kiln includes a drive mechanism having a gear extending around said kiln.

8. The solar heated rotary kiln of claim 1, wherein said means for rotating said kiln includes at least one drive roller in frictional contact with said kiln, and means for rotating said drive roller.

9. The solar heated rotary kiln of claim 8, wherein said means for rotating said drive roller includes a variable speed motor.

10. The solar heated rotary kiln of claim 8, wherein said means for rotating said kiln additionally includes a plurality of idling rollers positioned intermediate said kiln and said sealed container.

11. The solar heated rotary kiln of claim 1, wherein said means for directing material to be decomposed into said kiln includes a feed tube extending through said sealed container into said opposite end of said kiln.

12. The solar heated rotary kiln of claim 11, wherein said means for directing material to be decomposed into said kiln additionally includes a feeder mechanism located exterior of said sealed container and operatively mounted so as to direct material into said feed tube.

13. The solar heated rotary kiln of claim 12, wherein said feeder mechanism includes a hopper and a screw type feeder means.

14. The solar heated rotary kiln of claim 12, wherein said feeder mechanism includes a hopper and a vibratory type feeder means.

15. The solar heated rotary kiln of claim 1, wherein said inner liner includes a lip portion which protrudes outwardly from said layer of insulation.

16. The solar heated rotary kiln of claim 1, wherein said layer of insulation includes a plurality of separate layers of insulating materials.

17. The solar heated rotary kiln of claim 16, wherein said layer of insulation additionally includes a plurality of rings of insulation material positioned at opposite ends of at least certain of said plurality of separate layers of insulating materials.

18. The solar heated rotary kiln of claim 1, additionally including a restrictor means adjustably positioned in said sealed container adjacent said window for restricting reradiation losses of the solar energy.

19. The solar heated rotary kiln of claim 1, additionally including means for cooling said sealed container.

* * * * *